US009677566B2

(12) United States Patent
Sishtla

(10) Patent No.: US 9,677,566 B2
(45) Date of Patent: Jun. 13, 2017

(54) CENTRIFUGAL COMPRESSOR INLET GUIDE VANE CONTROL

(71) Applicant: Carrier Corporation, Farmington, CT (US)

(72) Inventor: Vishnu M. Sishtla, Manlius, NY (US)

(73) Assignee: CARRIER CORPORATION, Farmington, CT (US)

( * ) Notice: Subject to any disclaimer, the term of this patent is extended or adjusted under 35 U.S.C. 154(b) by 253 days.

(21) Appl. No.: 14/433,316

(22) PCT Filed: Aug. 9, 2013

(86) PCT No.: PCT/US2013/054272

§ 371 (c)(1),
(2) Date: Apr. 2, 2015

(87) PCT Pub. No.: WO2014/058524

PCT Pub. Date: Apr. 17, 2014

(65) Prior Publication Data

US 2015/0275908 A1 Oct. 1, 2015

Related U.S. Application Data

(60) Provisional application No. 61/744,278, filed on Oct. 9, 2012.

(51) Int. Cl.
*F04D 27/00* (2006.01)
*F04D 27/02* (2006.01)
(Continued)

(52) U.S. Cl.
CPC ..... *F04D 27/002* (2013.01); *F04D 17/10* (2013.01); *F04D 27/0246* (2013.01);
(Continued)

(58) Field of Classification Search
CPC ..... F04D 27/002
See application file for complete search history.

(56) References Cited

U.S. PATENT DOCUMENTS 2,817,213 A * 12/1957 Miner ..... F25B 1/053 236/82
3,973,391 A 8/1976 Reed et al.
(Continued)

FOREIGN PATENT DOCUMENTS

CN 102128179 A 7/2011
CN 102472292 A 5/2012
(Continued)

OTHER PUBLICATIONS

Notification of Transmittal of the International Search Report and the Written Opinion of the International Searching Authority, or the Declaration for PCT/US2013/054272; Mailed Jan. 22, 2014; pp. 1-10.
(Continued)

*Primary Examiner* — Craig Kim
*Assistant Examiner* — Eldon Brockman
(74) *Attorney, Agent, or Firm* — Cantor Colburn LLP

(57) ABSTRACT

A method of positioning an inlet guide vane assembly before start-up of a chiller system including a compressor, a condenser, and a cooler is provided including receiving a first input form sensors located in the cooler and the condenser. A saturation temperature is calculated based on the input from the sensors. A second input indicative of a minimum speed of a motor coupled to the compressor at start-up is received. Using the calculated saturation temperature and the second input, an allowable position of the inlet guide vane assembly is determined. The inlet guide vane assembly is then moved to the determined allowable position.

17 Claims, 6 Drawing Sheets

(51) Int. Cl.

| | |
|---|---|
| ***F25B 49/02*** | (2006.01) |
| ***F04D 29/46*** | (2006.01) |
| ***F04D 29/42*** | (2006.01) |
| ***F04D 17/10*** | (2006.01) |

(52) U.S. Cl.

CPC ..... *F04D 29/4213* (2013.01); *F04D 29/462* (2013.01); *F25B 49/022* (2013.01); *F05D 2250/51* (2013.01); *F25B 2500/26* (2013.01); *F25B 2600/024* (2013.01); *F25B 2600/0262* (2013.01); *F25B 2600/2515* (2013.01); *F25B 2700/151* (2013.01); *F25B 2700/195* (2013.01); *F25B 2700/197* (2013.01); *F25B 2700/1931* (2013.01); *F25B 2700/1933* (2013.01); *F25B 2700/21162* (2013.01); *F25B 2700/21175* (2013.01)

(56) References Cited

U.S. PATENT DOCUMENTS

| | | | | | |
|---|---|---|---|---|---|
| 4,227,862 | A | * | 10/1980 | Andrew | F04C 28/06 417/12 |
| 4,270,361 | A | * | 6/1981 | La Barge | F25B 1/053 62/158 |
| 4,381,650 | A | * | 5/1983 | Mount | F25B 1/053 62/157 |
| 4,399,663 | A | * | 8/1983 | Hesler | F04C 29/021 417/281 |
| 4,514,989 | A | * | 5/1985 | Mount | F25B 49/025 361/22 |
| 4,535,598 | A | * | 8/1985 | Mount | F25B 49/005 62/126 |
| 4,535,607 | A | * | 8/1985 | Mount | F25B 49/022 62/201 |
| 4,538,422 | A | * | 9/1985 | Mount | F25B 1/053 62/201 |
| 4,546,618 | A | | 10/1985 | Kountz et al. | |
| 4,589,060 | A | * | 5/1986 | Zinsmeyer | G05D 23/1912 62/201 |
| 4,611,969 | A | | 9/1986 | Zinsmeyer | |
| 4,686,834 | A | | 8/1987 | Haley et al. | |
| 4,989,403 | A | | 2/1991 | Rodgers | |
| 5,537,830 | A | | 7/1996 | Goshaw et al. | |
| 5,553,997 | A | | 9/1996 | Goshaw et al. | |
| 5,669,225 | A | | 9/1997 | Beaverson et al. | |
| 5,746,062 | A | | 5/1998 | Beaverson et al. | |
| 6,341,238 | B1 | | 1/2002 | Modeen et al. | |
| 6,581,399 | B2 | | 6/2003 | Benedict et al. | |
| 7,328,587 | B2 | | 2/2008 | Shaffer et al. | |
| 7,972,105 | B2 | | 7/2011 | Dejoris et al. | |
| 2011/0048046 | A1 | | 3/2011 | Sommer et al. | |
| 2011/0056210 | A1 | | 3/2011 | Griffin et al. | |
| 2011/0182715 | A1 | | 7/2011 | Leithead et al. | |

FOREIGN PATENT DOCUMENTS

| | | | |
|---|---|---|---|
| CN | 102713304 | A | 10/2012 |
| EP | 0186332 | A1 | 7/1986 |
| EP | 1429032 | A3 | 6/2004 |
| WO | 2011049891 | A1 | 4/2011 |

OTHER PUBLICATIONS

Chinese Office Action for application CN 201380052816.2, dated Apr. 1, 2016, 7 pages.

* cited by examiner

CENTRIFUGAL COMPRESSOR INLET GUIDE VANE CONTROL

BACKGROUND OF THE INVENTION

The invention relates generally to chiller refrigeration systems and, more particularly, to a method of maximizing the cooling capacity of the chiller refrigeration system at start-up.

In many conventional chillers, the compressor, such as a centrifugal compressor for example, is driven by a driving means, such as an electric motor for example, either directly or through a transmission. Optimum performance of the compressor is strongly influenced by the rotating speed of the compressor. The volume of refrigerant flowing through the compressor must be adjusted for changes in the load demanded by the air conditioning requirements of the space being cooled. Control of the flow is typically accomplished by varying the inlet guide vanes and the impeller speed, either separately or in a coordinated manner.

When a conventional chiller system is initially started, the inlet guide vanes are typically in a fully closed position, allowing only a minimum amount of flow into the compressor to prevent the motor from stalling. Only when the motor reaches a full speed will the system begin to open the inlet guide vanes, thereby increasing the capacity of the system. Consequently, a significant amount of time may elapse from when the chiller system is initially started until the guide vanes are fully open and the system is operating at maximum capacity. Some applications, such as data centers for example, require the system to reach a maximum capacity in a shorter amount of time than is allowable using a conventional system.

BRIEF DESCRIPTION OF THE INVENTION

According to an aspect of the invention, a method of positioning an inlet guide vane assembly before start-up of a chiller system including a compressor, a condenser, and a cooler is provided including receiving a first input from sensors located in the cooler and the condenser. A saturation temperature is calculated based on the input from the sensors. A second input indicative of a minimum speed of a motor coupled to the compressor at start-up is received. Using the calculated saturation temperature and the second input, an allowable position of the inlet guide vane assembly is determined. The inlet guide vane assembly is then moved to the determined allowable position.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
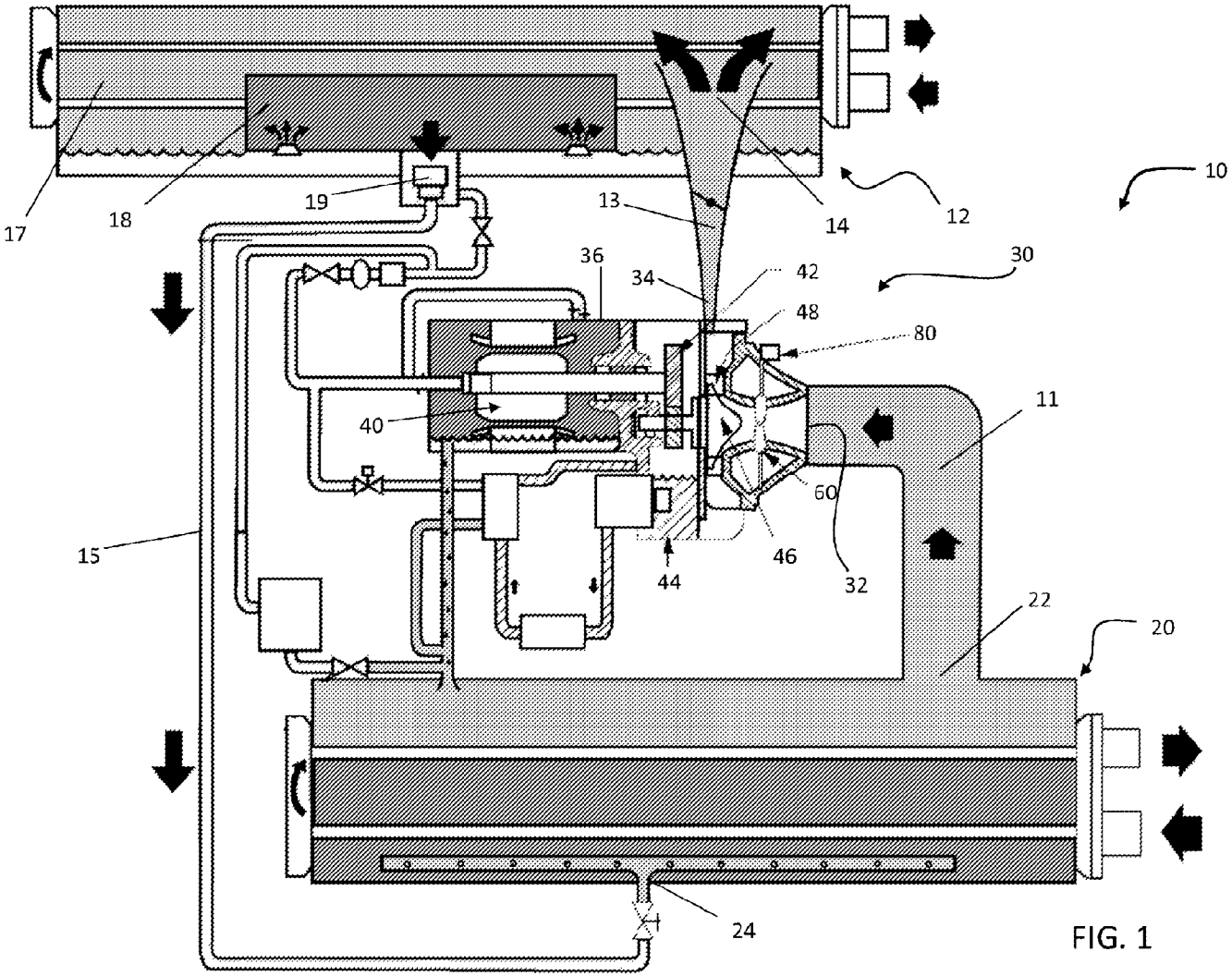
FIG. 1 is a schematic illustration of an exemplary chiller refrigeration system.
Figure 2:
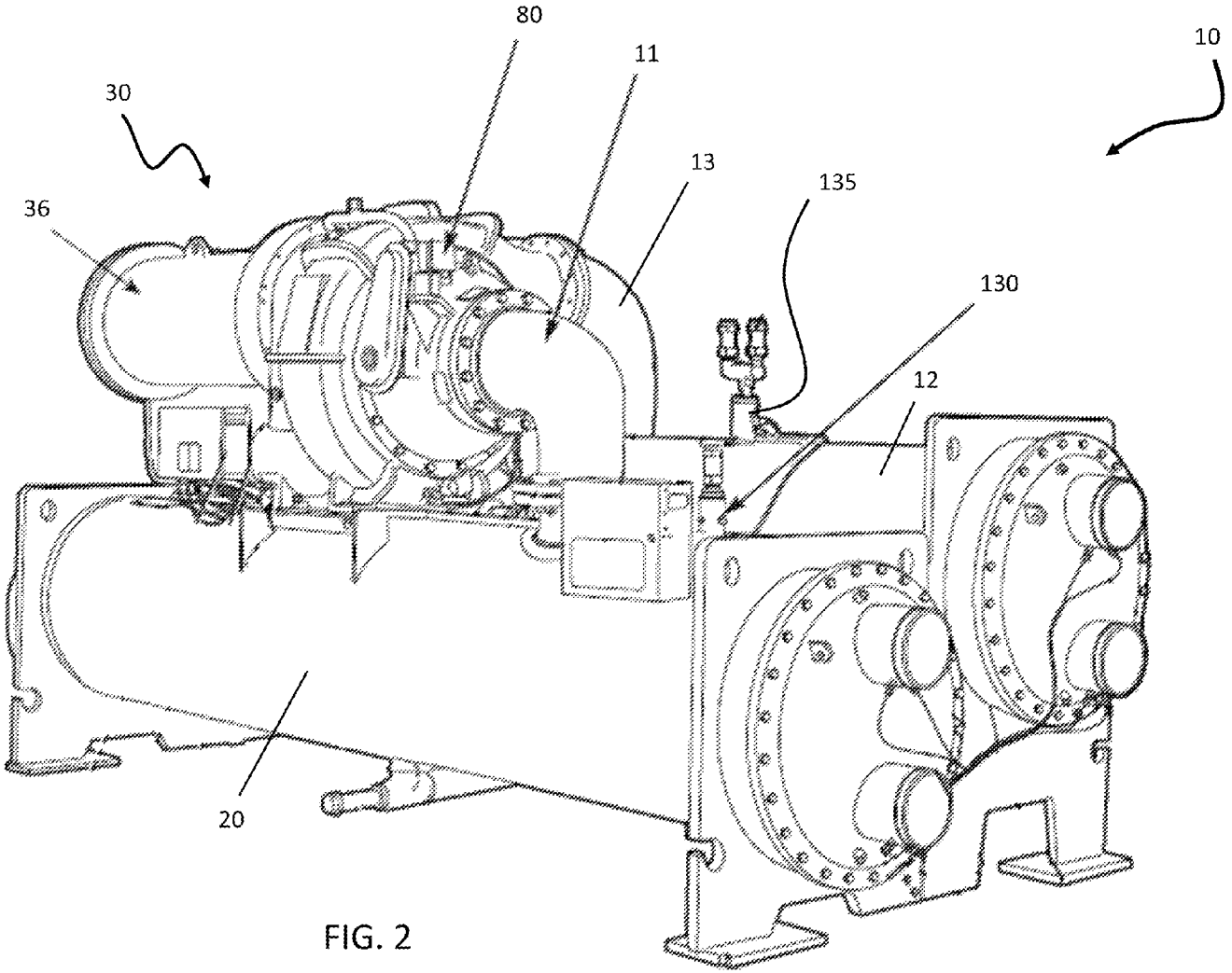
FIG. 2 is a perspective view of an exemplary chiller refrigeration system.

Referring now to FIGS. 1 and 2, the illustrated exemplary chiller refrigeration system 10 includes a compressor assembly 30, a condenser 12, and a cooler or evaporator 20 fluidly coupled to form a circuit. A first conduit 11 extends from adjacent the outlet 22 of the cooler 20 to the inlet 32 of the compressor assembly 30. The outlet 34 of the compressor assembly 30 is coupled by a conduit 13 to an inlet 14 of the condenser 12. In one embodiment, the condenser 12 includes a first chamber 17, and a second chamber 18 accessible only from the interior of the first chamber 17. A float valve 19 within the second chamber 18 is connected to an inlet 24 of the cooler 20 by another conduit 15. Depending on the size of the chiller system 10, the compressor assembly 30 may include a rotary, screw, or reciprocating compressor for small systems, or a screw compressor or centrifugal compressor for larger systems. A typical compressor assembly 30 includes a housing 36 having a motor 40 at one end and a centrifugal compressor 44 at a second, opposite end, with the two being interconnected by a transmission assembly 42. The compressor 44 includes an impeller 46 for accelerating the refrigerant vapor to a high velocity, a diffuser 48 for decelerating the refrigerant to a low velocity while converting kinetic energy to pressure energy, and a discharge plenum (not shown) in the form of a volute or collector to collect the discharge vapor for subsequent flow to a condenser. Positioned near the inlet 32 of the compressor 30 is an inlet guide vane assembly 60. Because a fluid flowing from the cooler 20 to the compressor 44 must first pass through the inlet guide vane assembly 60 before entering the impeller 46, the inlet guide vane assembly 60 may be used to control the fluid flow into the compressor 44.

The refrigeration cycle within the chiller refrigeration system 10 may be described as follows. The compressor 44 receives a refrigerant vapor from the evaporator/cooler 20 and compresses it to a higher temperature and pressure, with the relatively hot vapor then passing into the first chamber 17 of the condenser 12 where it is cooled and condensed to a liquid state by a heat exchange relationship with a cooling medium, such as water or air for example. Because the second chamber 18 has a lower pressure than the first chamber 17, a portion of the liquid refrigerant flashes to vapor, thereby cooling the remaining liquid. The refrigerant vapor within the second chamber 18 is re-condensed by the cool heat exchange medium. The refrigerant liquid then drains into the second chamber 18 located between the first chamber 17 and the cooler 20. The float valve 19 forms a seal to prevent vapor from the second chamber 18 from entering the cooler 20. As the liquid refrigerant passes through the float valve 19, the refrigerant is expanded to a low temperature two phase liquid/vapor state as it passed into the cooler 20. The cooler 20 is a heat exchanger which allows heat energy to migrate from a heat exchange medium, such as water for example, to the refrigerant gas. When the gas returns to the compressor 44, the refrigerant is at both the temperature and the pressure at which the refrigeration cycle began.

Figure 3:
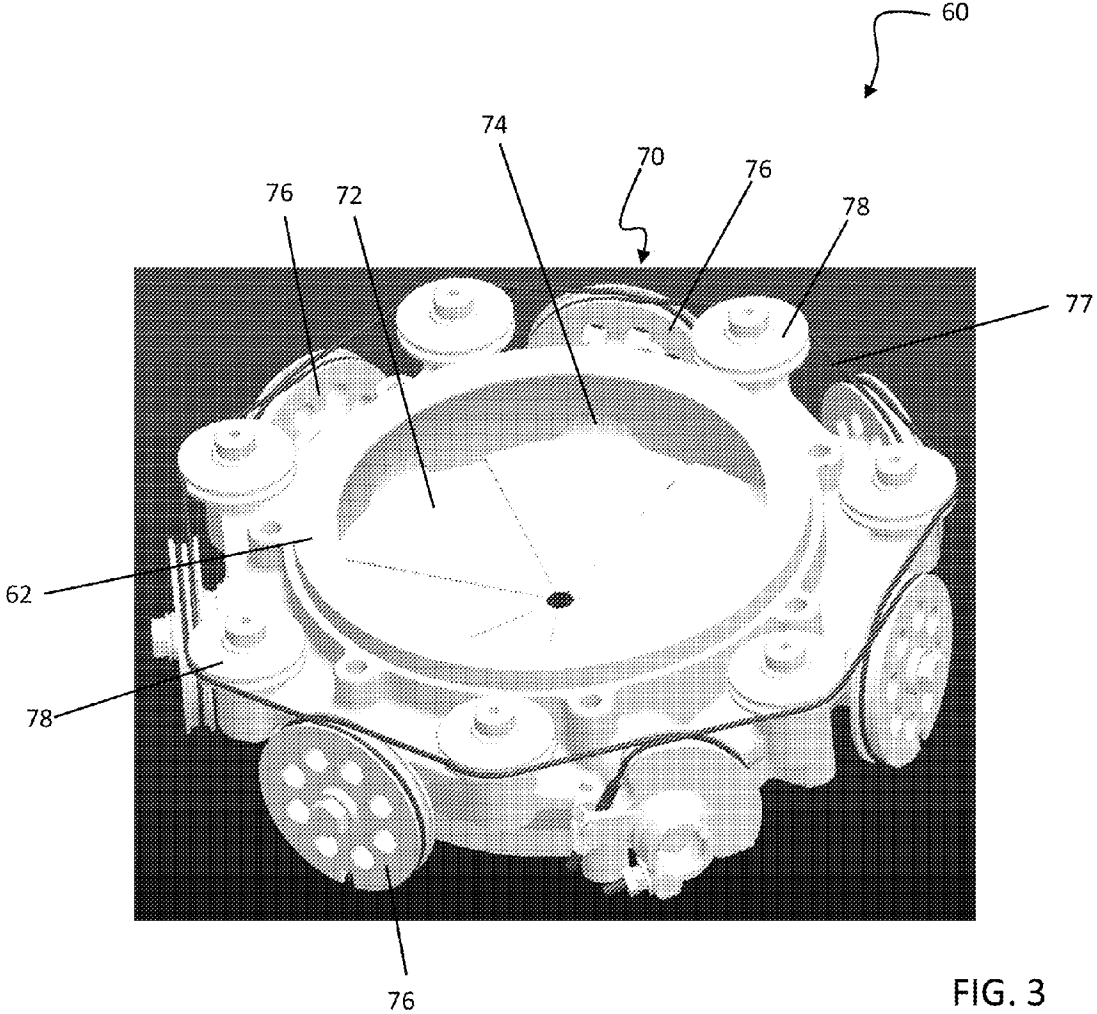
FIG. 3 is a perspective view of an exemplary inlet guide vane assembly.
Figure 4:
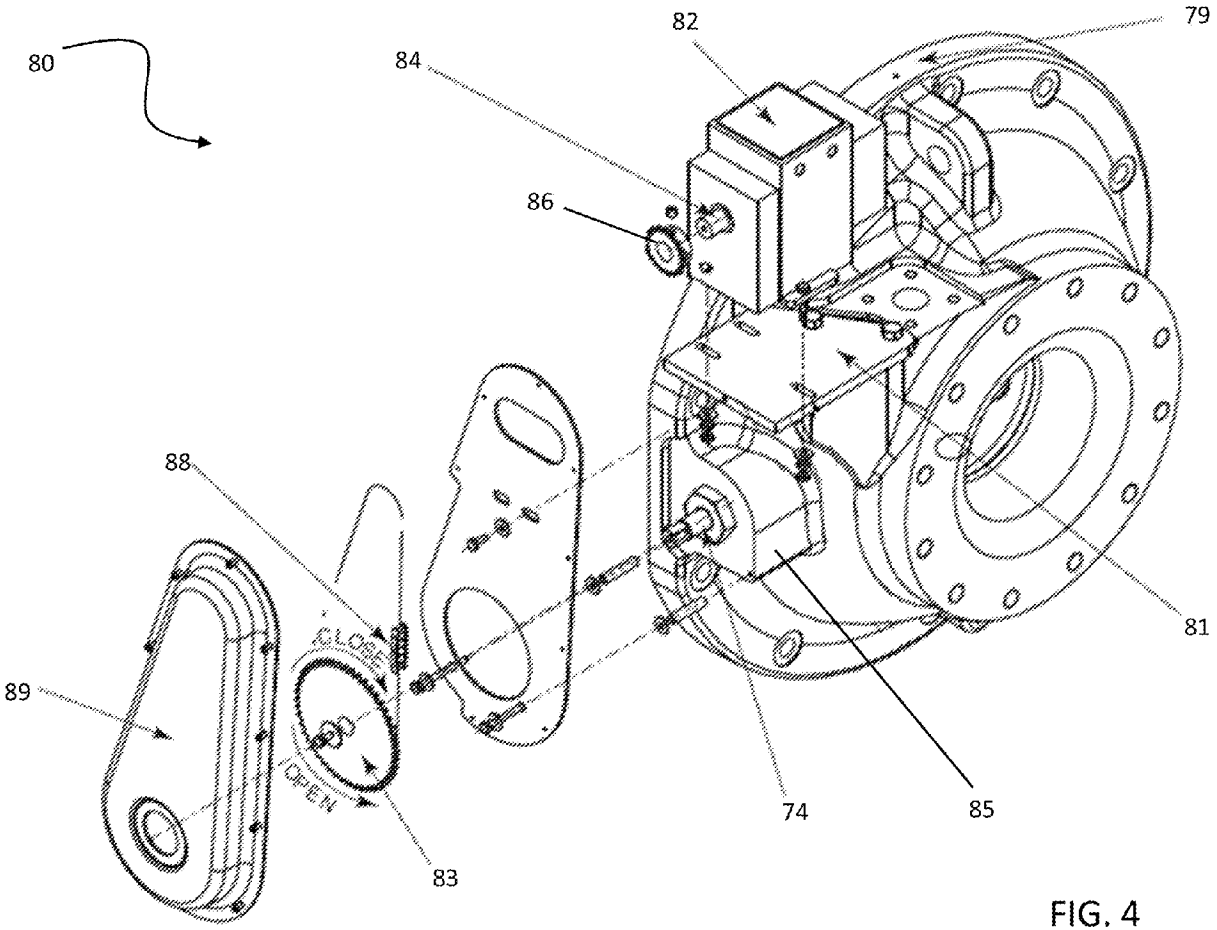
FIG. 4 is a perspective view of an exemplary inlet guide vane actuation system.

Referring now to FIGS. 3 and 4, an exemplary inlet guide vane assembly 60 is illustrated in more detail. The inlet guide vane assembly 60 includes a plurality of guide vane subassemblies 70 and a blade ring housing 62. Each guide vane subassembly 70 includes a generally flat air foil vane 72, a blade pulley 76 positioned adjacent an exterior of the blade ring housing 62, and a vane shaft 74 connecting the vane 72 to the blade pulley 76. The vane shaft 74 rotates within a bearing mounted in the blade ring housing 62. The inlet guide vane assembly 60 additionally includes a plurality of idler pulleys 78 mounted to the blade ring housing 62 between adjacent blade pulleys. A cable 77 is wound around the plurality of idler pulleys 78 and blade pulleys 76. The inlet guide vane assembly 60 is mounted within a suction housing 79.

The inlet guide vane assembly 60 includes an actuation system 80 for moving the guide vane subassemblies 70 between a closed position and an open position. A guide vane actuator 82 is mounted to a portion of the suction housing 79, such as with the illustrated bracket 81 for example. An actuator shaft 84 extending from the guide vane actuator 82 includes an actuator sprocket 86. One of the blade pulleys 76 acts as a driving pulley and is configured to couple the plurality of blade pulleys 76 to the actuation system 80. The vane shaft 74 of the drive pulley extends through a sealing assembly of the suction housing 79 and connects to a drive sprocket 83. The sealing assembly 85 prevents leakage of refrigerant to the atmosphere. The drive sprocket 83 and the actuator sprocket 86 are connected by a chain 88, such that rotation of the actuator shaft 84 causes the plurality of idler pulleys 78 and blade pulleys 76 to rotate relative to the blade ring housing 62. The actuation system 80 may be enclosed within a casing 89 to prevent dust from gathering and to prevent injuries while the compressor 30 is being serviced. The described actuation method is for illustrative purposes only, and additional actuation methods for rotating the plurality of inlet guide vane subassemblies 70 are within the scope of this invention.

Figure 5:
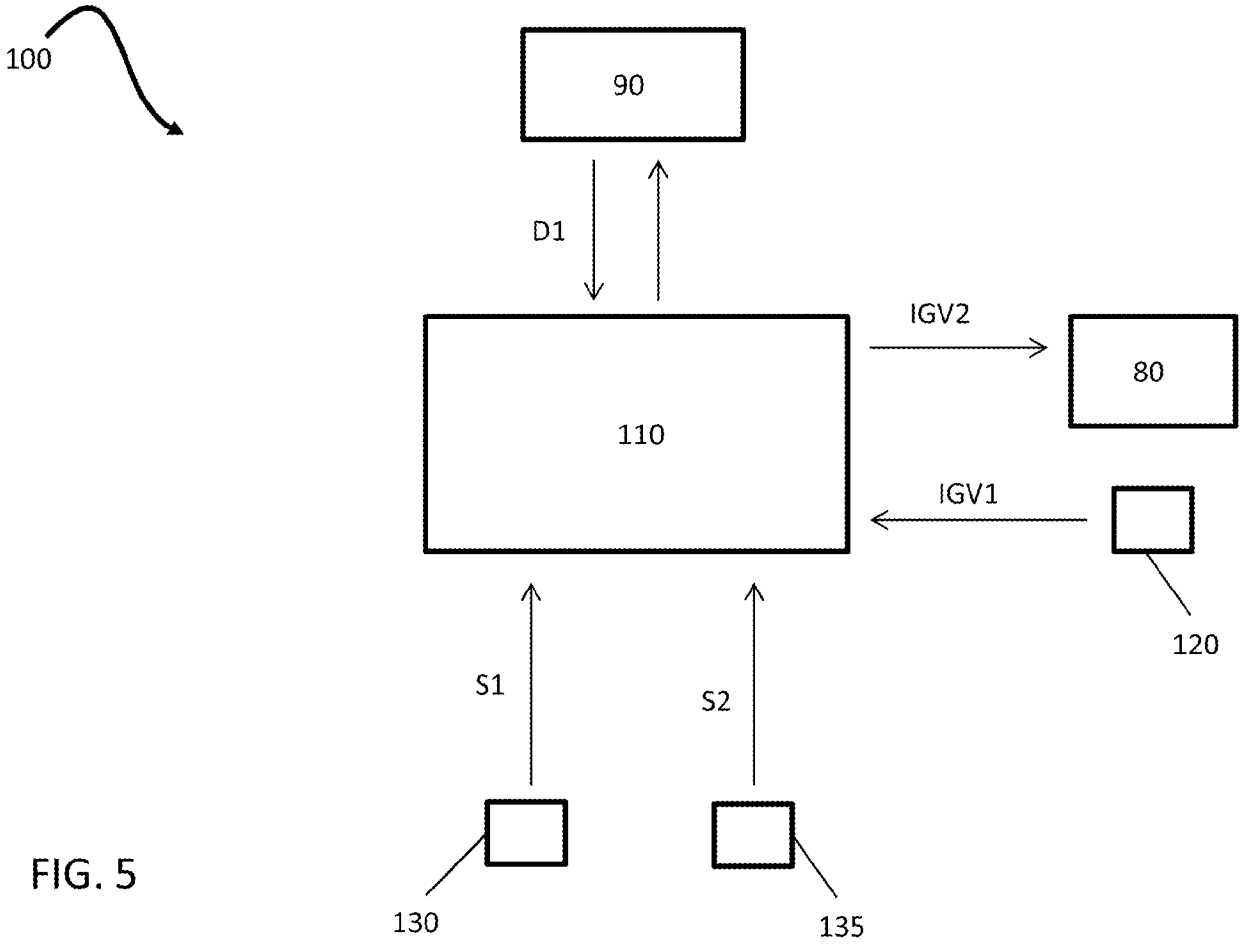
FIG. 5 is a control system for a chiller refrigeration system in accordance with an embodiment of the invention.

A control system 100 including a controller 110, illustrated in FIG. 5, controls the operation of the chiller refrigeration system 10. Controller 110 may be implemented using a general-purpose controller executing a computer program to perform the operations described herein. Controller 110 may be implemented using hardware (e.g., ASIC, FPGA) and/or a combination of hardware and software. One function of the controller 110 is to control the cooling capacity of the chiller 10, in response to load conditions, such as by adjusting the positioning of the inlet guide vane assembly 60 for example. A sensor 120, such as a potentiometer for example, coupled to a portion of the inlet guide vane assembly 60 provides an input signal IGV1 to the controller 110 indicative of the position of the guide vane subassemblies 70. The microcontroller 110 is also configured to communicate with the inlet guide vane actuation system 80 such that an output signal from the controller 110 will cause the actuation system 80 to adjust the position of the inlet guide vane subassemblies 70.

The control system 100 includes an additional plurality of sensors configured to provide an input to the controller 110. In one embodiment, a first sensor 130 is a pressure transducer configured to provide an input signal P1 to the controller 110 indicative of the absolute pressure in the cooler 20. A second sensor 135 may be a pressure transducer configured to provide an input signal P2 to the controller 110 indicative of the absolute pressure in the condenser 12. The pressure transducers 130, 135 may be located in the conduit 11 extending between the cooler 20 and the compressor inlet 32, and the conduit 13 extending between the compressor outlet 34 and the condenser inlet 14 respectively. The pressure transducers 130, 135 will sense pressures representative of the discharge and suction pressures of the compressor 44. In another embodiment, the first and second sensors 130, 135 are temperature thermistors. The first thermistor 130 will sense the temperature of the refrigerant near the outlet 22 of the cooler 20, and the second thermistor 135 will sense the temperature of the refrigerant near the inlet 14 of the condenser 12. Alternatively, one of the first sensor 130 and the second sensor 135 may be a pressure sensor and the other of the first sensor 130 and the second sensor 135 may be a temperature sensor. The microcontroller 110 of the control system 100 is also configured to communicate with the drive 90 of the motor 40. The drive 90 controls the current drawn by the motor 40, and therefore regulates the speed of the compressor 44. In one embodiment, the drive is a variable speed drive.

Figure 6:
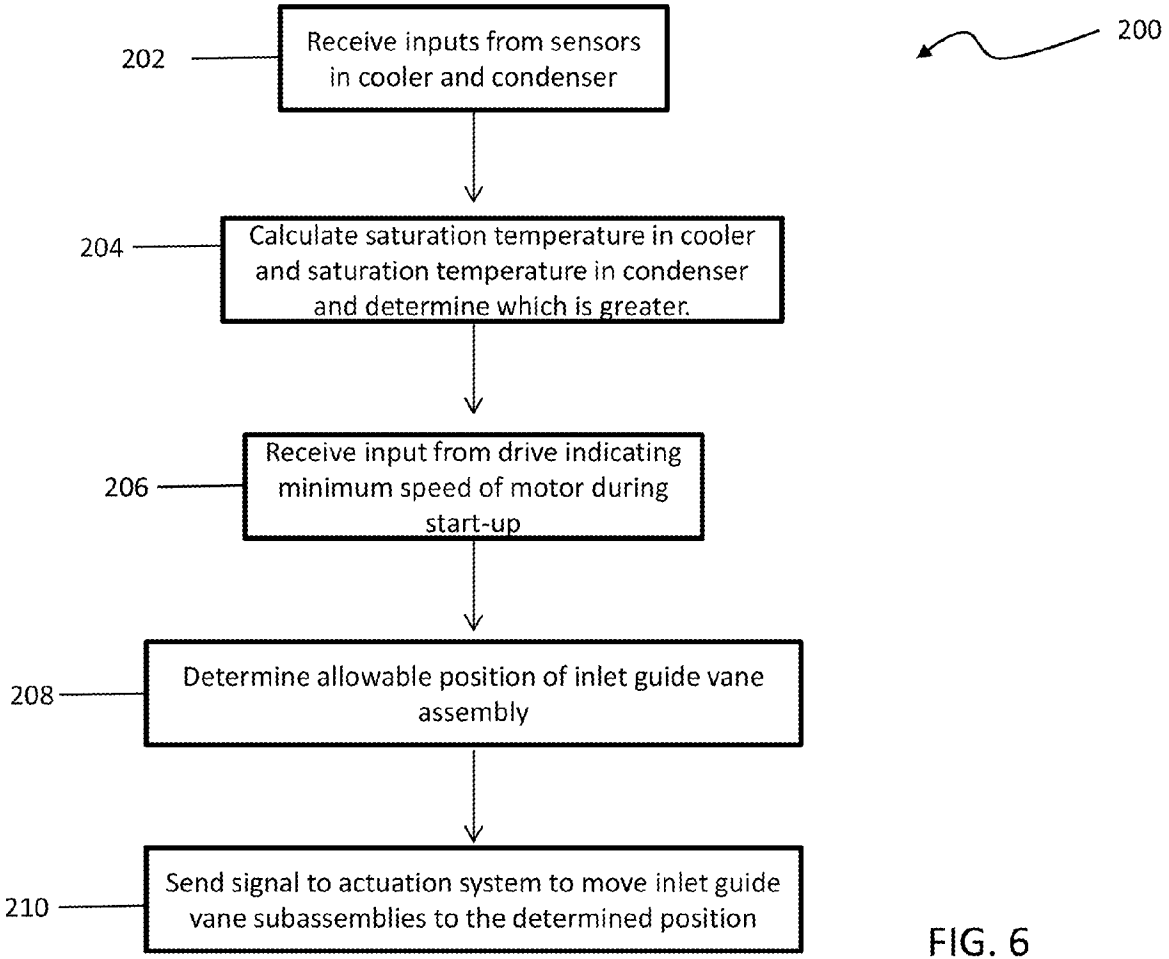
FIG. 6 is a method for determining an allowable position of the inlet guide vane assembly before start-up of the chiller refrigeration system in accordance with an embodiment of the invention.

A method 200 is provided in FIG. 6 for reducing the time required to maximize the capacity of the chiller system 10 at start-up by adjusting the position of the inlet guide vane subassemblies 70 to a partially open position before power is applied to the compressor 44. As shown in block 202, when the motor is in an idle, non-rotating state, the controller receives the input S1 from the first sensor 130 indicative of the pressure in the cooler 20, and the input S2 from the second sensor 135 indicative of the pressure in the condenser 12. The controller 110 then uses these collected pressure values, as shown in block 204, to calculate the saturation temperature in both the cooler 20 and the condenser 12 using an algorithm stored in the controller 110. Because the chiller refrigeration system 10 is not running, the cooler pressure and the condenser pressure should be about the same, and therefore the resultant saturation temperatures should be generally equivalent. However, in instances, where the saturation temperatures differ, the higher, more conservative, temperature will be used to determine an allowable position of the inlet guide vane assembly 60 as described in more detail below. In embodiments where the sensors 130, 135 are thermistors, the controller 110 will first convert the input S1, S2 from the thermistors into a pressure, and then from that pressure will calculate a corresponding saturation temperature.

In block 206, the controller 110 receives an input D1 from the drive 90 indicative of a selected operating speed of the motor 40 during start-up. In systems having a non-variable frequency drive, the selected operating speed during start-up may equal the full speed of the motor 40. In systems 10 having a variable frequency drive, the selected operating speed during start-up may range from about 65% to 100% of full speed depending on the settings of that chiller refrigeration system 10.

As shown in block 208, an algorithm for determining the allowable position of the inlet guide vane assembly may be stored within the controller 110 of the control system 100. The selected operating speed D1 and the maximum calculated saturation temperature as input into the algorithm to calculate the allowable position of the inlet guide vanes for the system. Alternatively, a positioning table that identifies a range of saturation temperatures and inlet guide vanes associated with each saturation temperature may be stored within the controller 110. The table is generated based on an assumed selected operating speed of the compressor 44 during start-up. A plurality of vane positioning tables for a range of minimum speeds may be stored within the controller 110. In one embodiment, the controller 110 includes a vane positioning table for a selected operating speed of about 65% and includes additional tables taken at intervals, such as every 7% for example, until full speed is reached. Based on the selected operating speed D1 input to the controller 110 from the drive 90, the controller 110 will select a corresponding vane positioning table. After selecting the maximum saturation temperature calculated based on the inputs S1, S2 from the condenser 12 and the cooler 20, the controller 110 can identify an allowable position of the inlet guide vane subassemblies 70. In block 210, the controller 110 then sends a signal to the actuation system 80 to move the inlet guide vane subassemblies 70 to the determined allowable position.

During a conventional start-up of a chiller refrigeration system 100, the inlet guide vane subassemblies 70 are in a closed position so that only a minimum flow enters the inlet 32 of the compressor 30. However, because the sensed pressures or temperatures S1, S2 in the cooler 20 and condenser 12 are less than the worst-case scenario assumed during design of the compressor 44, the inlet guide vane subassemblies 70 may be partially opened before start-up, thereby allowing a greater initial volumetric flow. By partially opening the guide vanes 70, the time required to move the inlet guide vanes 70 to a fully open position once the compressor 44 is operating is reduced. In addition, because the inlet guide vanes 70 have a shorter distance to move to reach a fully open position, the compressor 44 may more efficiently reach a maximum cooling capacity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of positioning an inlet guide vane assembly before start-up of a chiller system including a compressor, a condenser, and a cooler, the method comprising:

receiving a first input from sensors located in the cooler and the condenser;

calculating a saturation temperature based on the first input from the sensors;

receiving a second input indicative of a minimum speed of a motor coupled to the compressor at start-up;

determining an allowable position of the inlet guide vane assembly based on the calculated saturation temperature and the second input; and moving the inlet guide vane assembly to the determined allowable position.

2. The method according to claim 1, wherein the chiller system includes a control system having a controller.

3. The method according to claim 1, wherein the first input from the sensors is provided to a controller.

4. The method according to claim 1, wherein the sensors located in the cooler and condenser are pressure sensors.

5. The method according to claim 1, wherein the sensors located in the cooler and condenser are temperature sensors.

6. The method according to claim 5, further comprising converting the first input from the temperature sensors into a pressure to calculate the saturation temperature.

7. The method according to claim 2, wherein an algorithm for converting a pressure into the saturation temperature is stored within the controller.

8. The method according to claim 1, wherein a cooler saturation temperature is determined for the cooler and a condenser saturation temperature is determined for the condenser based on the first input.

9. The method according to claim 8, wherein the cooler saturation temperature is compared to the condenser saturation temperature and whichever is greater is used to determine an allowable position of the inlet guide vane assembly.

10. The method according to claim 2, wherein a drive coupled to the motor provides the second input to the controller.

11. The method according to claim 10, wherein if the drive is a non-variable frequency drive, the minimum speed of the motor at start up is full speed.

12. The method according to claim 10, wherein if the drive is a variable-frequency drive, the minimum speed of the motor may be in the range of between about 65% and 100% of a full speed of the motor.

13. The method according to claim 1, wherein at least one vane positioning table is stored in the controller, the vane positioning table having a range of saturation temperatures and a corresponding allowable position of the inlet guide vane assembly for each saturation temperature.

14. The method according to claim 13, wherein the vane positioning table is created based on an assumed minimum speed of the motor.

15. The method according to claim 14, wherein a controller has a plurality of vane positioning tables stored, the plurality of tables being configured for a range of minimum speeds of the motor at start-up.

16. The method according to claim 2, wherein the controller provides a signal to an actuation system coupled to the inlet guide vane assembly.

17. The method according to claim 1, wherein an algorithm for determining an allowable position of the inlet guide vane assembly based on the calculated saturation temperature and the second input is stored in the controller.

* * * * *